US012276171B2

(12) United States Patent
Manett et al.

(10) Patent No.: US 12,276,171 B2
(45) Date of Patent: Apr. 15, 2025

(54) CONTROL SYSTEM FOR A WELL CONTROL DEVICE

(71) Applicant: Expro North Sea Limited, Dyce (GB)

(72) Inventors: Kris Manett, Fraserburgh (GB); Jamie Drummond Walker, Kintore (GB)

(73) Assignee: EXPRO NORTH SEA LIMITED, Dyce (GB)

( * ) Notice: Subject to any disclaimer, the term of this patent is extended or adjusted under 35 U.S.C. 154(b) by 212 days.

(21) Appl. No.: 17/748,750

(22) Filed: May 19, 2022

(65) Prior Publication Data

US 2022/0372831 A1 Nov. 24, 2022

(30) Foreign Application Priority Data

May 19, 2021 (GB) ..... 2107147

(51) Int. Cl.
*E21B 33/064* (2006.01)
*E21B 33/035* (2006.01)

(52) U.S. Cl.
CPC ..... *E21B 33/064* (2013.01); *E21B 33/0355* (2013.01)

(58) Field of Classification Search
CPC ..... E21B 33/064; E21B 33/0355
USPC ..... 166/668
See application file for complete search history.

(56) References Cited

U.S. PATENT DOCUMENTS

| | | | | |
|---|---|---|---|---|
| 8,725,302 | B2 * | 5/2014 | Niemeyer | E21B 33/0355 700/282 |
| 9,033,049 | B2 * | 5/2015 | Kotrla | E21B 41/0007 166/368 |
| 10,954,737 | B1 * | 3/2021 | Nouh | E21B 17/017 |
| 2011/0308807 | A1 * | 12/2011 | Spencer | E21B 47/13 166/335 |
| 2019/0078426 | A1 | 3/2019 | Zheng | |
| 2021/0348467 | A1 * | 11/2021 | Baskett | E21B 33/038 |

FOREIGN PATENT DOCUMENTS

| | | |
|---|---|---|
| GB | 2528127 A | 1/2016 |
| WO | 2020030897 A1 | 2/2020 |

OTHER PUBLICATIONS

Search report for GB2107147.7 dated Oct. 20, 2021.

* cited by examiner

*Primary Examiner* — Matthew Troutman
*Assistant Examiner* — Patrick F Lambe
(74) *Attorney, Agent, or Firm* — Getz Balich LLC

(57) ABSTRACT

A control system for automatically operating a well control device located in a subsea blow-out preventer (BOP), has a first control unit and a second control unit. The first control unit is connected to the second control unit and issues an activation command to the second control unit to cause it to trigger actuation of the well control device, and the first control unit is configured to automatically issue the activation command to the second control unit on detecting issue of the signal indicative of a requirement to trigger actuation of the subsea BOP shear mechanism.

13 Claims, 4 Drawing Sheets

CONTROL SYSTEM FOR A WELL CONTROL DEVICE

This application claims priority to GB Patent Appln. No. 2107147.7 filed May 19, 2021, which is hereby incorporated herein by reference in its entirety.

BACKGROUND OF THE INVENTION

1. Technical Field

The present disclosure relates to a control system for operating a well control device, a well control arrangement comprising a well control device and a control system for automatically operating the well control device, and a well control assembly comprising a subsea BOP, a well control device, and a control system for operating the well control device. The present disclosure also relates to a method of operating a well control assembly. In particular, but not exclusively, the present disclosure relates to a control system for operating a well control device located in a subsea BOP, and an associated well control arrangement, assembly and method.

2. Background Information

In the oil and gas exploration and production industry, a well control device in the form of a blow-out preventer (BOP) is utilised to contain wellbore fluids in an annular space between wellbore tubing (casing) and smaller diameter tubing disposed within the casing or in an 'open hole' during well drilling, completion, and testing operations. The BOP comprises a shear mechanism, which comprises an arrangement of hydraulically operated shear rams, and seal rams which can seal around media extending through the BOP. The BOP provides ultimate pressure control of the well. In an emergency situation, the shear rams can be activated to sever any media extending through the BOP and shut-in the well.

The use of through-BOP intervention riser systems (TBIRS) is known in the industry. A TBIRS is used for through-riser deployment of equipment, such as completion architecture, well testing equipment, intervention tooling and the like into a subsea well from a surface vessel. When in a deployed configuration a landing string of the TBIRS extends between the surface vessel and a wellhead, in particular a subsea BOP on the wellhead. The TBIRS is run inside of a marine riser and subsea BOP system, and incorporates well control features in addition to those on the subsea BOP, typically a dedicated suite of valves.

While deployed the TBIRS provides many functions, including permitting the safe deployment of wireline or coiled tubing equipment through the landing string and into the well, providing well control barriers which are independent of the BOP, and permitting a sequenced series of device actions intended to achieve a safe-state in relation to a specific hazardous event such as emergency shut down (ESD) and emergency quick disconnect (EQD), while isolating both the well and a surface vessel from which the TBIRS is deployed.

Well control and isolation in the event of an emergency is provided by the TBIRS suite of valves, which is located at a lower end of the TBIRS, and positioned inside a central bore of the subsea BOP. The subsea BOP therefore restricts the maximum size of such valves. The valve suite can include a subsea test tree (SSTT) or other well barrier device, which provides a well barrier to contain well pressure, and a retainer valve which isolates the landing string contents and which can be used to vent trapped pressure from between the retainer valve and the SSTT (or other barrier device) prior to disconnection of a landing string of the TBIRS. A shear sub component extends between the retainer valve and the SSTT, which is capable of being sheared by the subsea BOP if required.

The TBIRS may accommodate wireline and/or coiled tubing deployed tools. Deployment of wireline or coiled tubing may be facilitated via a lubricator valve which is typically located proximate the surface vessel, for example below a rig floor. The various valve assemblies, such as the SSTT, require a sufficiently large internal diameter to permit unrestricted passage of such tools therethrough. However, the valve assemblies also have outer diameter limitations, as they required to be locatable within the subsea BOP. Such conflicting design requirements can create difficulty in, for example, achieving appropriate valve sealing, running desired tooling through the valves and the like.

Furthermore, the TBIRS requires to be capable of cutting any wireline or coiled tubing which extends therethrough in relation to a specific hazardous event such as emergency shut down (ESD) and emergency quick disconnect (EQD), and providing a seal afterwards. It is known in the art to use one or more valves of an SSTT to shear the wireline or coiled tubing upon closure, and provide a well barrier seal against the well flow.

When deploying a subsea BOP stack from a dynamically positioned (DP) vessel, there is a requirement to have an emergency disconnect system/sequence (EDS), whereas this is optional on moored vessels. The EDS is a programmed sequence that operates the subsea BOP to leave the BOP stack and controls in a desired state, to provide a well barrier and disconnect a lower marine riser package (LMRP) from a lower stack of the subsea BOP. During operation of the subsea BOP, one or more shear rams may be required to shear the TBIRS shear sub (including any wireline or coiled tubing deployed through the TBIRS) upon closure and provide a well barrier seal against well flow.

The number of sequences, timing, and functions of the EDS are specific to the rig, equipment, and location, however a current industry requirement is that a sequence must be completed in under 90 seconds. The EDS can be activated manually, or designed to automatically activate in relation to a specific hazardous event. In addition however, the subsea BOP shear rams can be activated outside of the EDS. Also, when deploying subsea BOP stacks from a surface vessel, there is a requirement to have a 'deadman' functionality, in which—upon loss of power and hydraulic supply to the subsea BOP—a sequence automatically operates the required functions to leave the subsea BOP stack and controls in a desired state, providing a well barrier and disconnecting the LMRP from the lower stack of the subsea BOP.

In the event of an emergency situation arising, the well may require to be contained by actuating the valve suite of the TBIRS. In extreme situations however, such as a 'loss of position' incident in a dynamically position (DP) vessel, this may require actuation of the BOP shear rams to sever any media extending through a bore of the BOP (such as the TBIRS shear sub, coiled tubing and/or wireline). There are different levels of emergency shutdown. Using the TBIRS, there is a process shutdown (PSD) in which a surface flow tree is closed to isolate the well at surface; an emergency shutdown (ESD), in which SSTT valves are closed, isolating the well downhole; and an emergency quick disconnect (EQD), in which the SSTT valves are closed, the retainer valve closed and an SSTT latch (connecting the SSTT to a remainder of the TBIRS) disconnected. In the case of an EQD, there requires to be sufficient time to activate the SSTT valves prior to actuation of the BOP shear rams, and to disconnect the remainder of the TBIRS from the SSTT prior to the subsea BOP shear rams moving.

The SSTT valves are actuated using hydraulic fluid, supplied from surface via control lines coupled to the SSTT. The SSTT valves failsafe to closed positions, via springs coupled to the valves. In the event of a loss of hydraulic control occurring, the springs act to move the valves to their closed position. However, significant force is required to shear media such as coiled tubing located in the valve bore. The spring force is not sufficient to sever such tubing. Accordingly, a hydraulic pressure force is applied to the valve, via the hydraulic control lines, to close the valves and shear the coiled tubing located in the valve bore.

A problem can therefore occur when the BOP shear rams are actuated, via human intervention, EDS or deadman functionality. This is because actuation of the BOP shear rams severs the control lines, isolating the SSTT valves from their supply of hydraulic control fluid. If the BOP shear rams are actuated prior to the SSTT valves, this has the result that the bore of the SSTT cutting valve could be blocked by the coiled tubing (or other media) extending through the SSTT. The SSTT valve bore would then remain open, pressure control then being provided solely by the BOP. This removes a level of redundancy in the system.

It is therefore desirable to provide a system which can actuate an SSTT (or any other suitable well control device) valve or valves prior to closure of BOP shear rams, to ensure closure of the SSTT.

SUMMARY

According to a first aspect of the present disclosure, there is provided a control system for automatically operating a well control device located in a subsea blow-out preventer (BOP), the control system comprising: a first control unit configured to detect a signal indicative of a requirement to trigger actuation of a shear mechanism of the subsea BOP, to cause the shear mechanism to move from a deactivated state to an activated state in which it provides a well control function; and a second control unit adapted to be connected to the well control device, for triggering actuation of the well control device to cause it to move from a deactivated state to an activated state in which the well control device provides a well control function; in which the first control unit is adapted to be connected to the second control unit and configured to issue an activation command to the second control unit to cause it to trigger actuation of the well control device; in which the first control unit is configured to automatically issue the activation command to the second control unit on detecting issue of the signal indicative of a requirement to trigger actuation of the subsea BOP shear mechanism; and in which the first control unit and the second control unit are configured so that the activation command is issued to the second control unit to trigger actuation of the well control device prior to actuation of the subsea BOP shear mechanism.

The control system of the present disclosure may provide the advantage that the system can automatically trigger actuation of the well control device, prior to actuation of the subsea BOP shear mechanism, when a requirement to trigger actuation of the shear mechanism is detected. In this way, actuation of the well control device can be ensured, as actuation is effected prior to any control equipment coupled to the well control device being disconnected, for example hydraulic control lines coupled to the device which could be severed by the subsea BOP.

The first control unit may be a surface unit, and/or may be adapted to be provided at surface. Reference to the first control unit being a surface unit and/or being provided at surface should be taken to encompass the unit being provided on or at a rig or other surface facility, although it is conceivable that the unit could be provided on or at seabed level.

The second well control unit may be adapted to be provided subsea. This may provide the advantage that the second well control unit can rapidly actuate the well control device on receipt of the activation command.

The first well control unit may be connected to the second well control unit via at least one control line, which may be an electrical control line. The first well control unit may be adapted to be acoustically connected to the second well control unit. The first control unit may be configured to issue an electrical and/or acoustic activation command to the second control unit. This may provide the advantage that the activation command can be transmitted to the second control unit relatively rapidly, on detection of the signal indicative of a requirement to trigger actuation of the subsea BOP shear mechanism (by the first control unit).

Issuance of an electrical and/or acoustic activation command may represent a relatively fast means of communication, which may in turn facilitate actuation of the well control device prior to the subsea BOP shear mechanism. In accordance with standard practice, the subsea BOP is fluid actuated, requiring a volume of high pressure fluid to actuate shear and/or seal rams of the device, transmitted via hydraulic control lines extending from a source of hydraulic fluid to the subsea BOP. There can be a delay of perhaps 35 to 40 seconds between issue of an activation command at surface and actuation of the subsea BOP shear mechanism. In contrast, it is expected that a delay of no more than perhaps 5 seconds may be experienced between detection of the signal indicative of a requirement to trigger the subsea BOP shear mechanism, and actuation of the well control device.

Other means of connecting the first control unit to the second control unit may be employed, including but not restricted to electromagnetic signalling equipment comprising a transmitter associated with the first control unit and a receiver associated with the second control unit, which may be adapted to transmit and receive radio frequency or acoustic (e.g. ultrasonic) frequency signals, respectively. Tubing such as a landing string coupled to the second control unit may act as a signal transmission medium.

The first control unit may be configured to detect an alarm signal indicative of a requirement to trigger actuation of the subsea BOP shear mechanism. The alarm signal may be triggered on detection of a change in a specified at least one parameter, or an at least one parameter threshold being reached. The parameter may be selected from the group comprising: a pressure of fluid in the wellbore; a flow rate of fluid; a flow direction of fluid; a surface vessel moving off station, such as through drive-off or drift-off; a loss of power and/or hydraulic supply to the subsea BOP; and a combination of two or more of such parameters. An increase in pressure of the fluid in the wellbore, and/or an unexpected flow of fluid into the wellbore, may occur during a 'kick' (e.g. when an unexpected high-pressure formation or zone is encountered during a downhole procedure).

The first control unit may be configured to detect at least one of: a) a signal which is issued by monitoring equipment and which is indicative of the requirement to trigger actuation of the subsea BOP shear mechanism to move to its activated state; and b) an activation command issued by control equipment to the subsea BOP shear mechanism, to trigger actuation of the shear mechanism to move to its activated state. The signal indicative of a requirement to trigger actuation of the subsea BOP shear mechanism may therefore be the signal issued by the monitoring equipment, and/or the activation command issued by the control equipment. Accordingly, one or both of the signal issued by the monitoring equipment, and the command signal issued by the control equipment, may be detectable by the first control unit. Option a) may apply in circumstances in which operator control is required to trigger actuation of the subsea BOP shear mechanism. Option b) may apply in circumstances in which actuation of the subsea BOP shear mechanism is automated.

The first control unit may comprise an interface configured to cooperate with the monitoring and/or control equipment, to recognise issue of the signal. The interface may be associated with a trigger for the subsea BOP shear mechanism, and may be configured to recognise operation of the trigger. The interface may comprise a pneumatic, hydraulic or electrical line which is adapted to be coupled to the monitoring and/or control equipment, and which communicates operation of the trigger to the first control unit.

The first control unit may be adapted to be connected to an emergency disconnect system (EDS), and/or a deadman system, which may form or comprise the monitoring and/or control equipment, and which may be arranged to issue the signal. The deadman system may be arranged so that, upon loss of power and/or hydraulic supply to the subsea BOP, a sequence in the deadman system automatically operates required functions to leave the subsea BOP stack in a desired state, providing a well barrier and facilitating disconnection of a lower marine riser package (LMRP) from a lower stack of the subsea BOP. The first control unit may be configured to cause the well control device to move to the activated state when the EDS/deadman system issues the signal. The first control unit may be configured to detect an alarm signal indicative of a requirement to trigger actuation of the subsea BOP shear mechanism. Operation of the EDS and/or deadman system may require a user input to trigger actuation of the subsea BOP shear mechanism. The first control unit may be configured to detect a signal indicating that the EDS and/or deadman system has been triggered into operation. Operation of the EDS and/or deadman system may be automatic, and may trigger the subsea BOP shear mechanism to move to the activated state.

The first control unit may be configured to operate a reeling device to withdraw coiled tubing (or other media) extending through a bore of the well control device. The first control unit may be configured to trigger the reeling device to actuate when the following conditions are satisfied: i) the requirement to actuate the subsea BOP shear mechanism is detected; ii) coiled tubing (or other media) is located in the bore of the well control device; and iii) actuation of the well control device (triggered by the activation command issued to the second control unit) presents the risk of at least one function of the well control device being restricted. The function may be closure of the well control device, and/or may be a sealing function of the well control device. The well control device may be or may comprise a valve assembly comprising a cutting valve, a cut and seal valve and/or a cutting valve and a sealing valve. The cutting valve may be provided below or downhole of the sealing valve (in normal use of the device). Operation of the cutting valve may therefore present a risk of the sealing valve (located above/uphole) being blocked by a portion of the severed coiled tubing. The first control unit may therefore be configured to trigger the reeling device to actuate when the sealing valve is located above/uphole of the cutting valve, and condition iii) involves a risk of the sealing valve being blocked by a severed portion of the coiled tubing. The first control unit may comprise a processor configured to trigger the reeling device to actuate when conditions i) to iii) are satisfied.

The second control unit may comprise a source of energy for actuating the well control device. The source of energy may be selected from the group comprising: a source of hydraulic energy; a source of electrical energy; and a combination of the two. The source of hydraulic energy may comprise a volume of pressurised fluid, and may be or comprise a hydraulic accumulator (in particular a subsea accumulator). The source of hydraulic energy may be charged with pressurised hydraulic fluid prior to deployment (e.g. to a subsea location), and/or may be connected to surface via at least one hydraulic line. The source of electrical energy may be or may comprise a battery, and/or an electrical power conduit extending to surface.

The second control unit may comprise at least one valve for controlling the flow of hydraulic fluid from the source of hydraulic energy to the well control device. The at least one valve may be triggered to move to from a closed position to an open position when the activation command is received by the second control unit. At least one valve may be electrically or electronically actuated, and may be a solenoid operated valve (SOV) and/or a directional control valve (DCV).

The second control unit may comprise a flow monitoring device, which may be adapted to be coupled to the well control device. Where the well control device is or comprises a valve assembly, the flow monitoring device may be adapted to be coupled to at least one valve of the valve assembly, and may serve for monitoring the flow of fluid from the valve and determining a corresponding actuation state of the valve. The flow monitoring device may serve for monitoring flow of fluid from the valve during movement of the valve from an open to a closed position. The flow monitoring device may be capable of determining an actuation state of the cutting valve by measuring a volume of fluid exiting the valve. Actuation of the valve to a fully closed state may require that a determined volume of fluid exit the valve (for example a hydraulic chamber of the valve). The flow monitoring device may determine that the valve has been fully closed when the determined volume of fluid is detected as having exited the valve. Where the valve assembly comprises a cutting valve, such monitoring of the valve position may enable a determination to be made as to whether the cutting valve has severed coiled tubing (or other media) extending through a bore of the well control device.

The second control unit may be configured to transmit information relating to the operation state of the valve, determined using the flow monitoring device, to the first control unit. The first control unit may be configured to employ the information to determine whether to actuate the reeling device. The first control unit may be configured to trigger the reeling device to actuate only when a further condition, which may be a condition iv), is satisfied, in which the valve is detected as having moved to its fully closed position. Where the valve is a cutting valve, this may ensure that the reeling device is not operated until such time as a determination has been made that the coiled tubing (or other media) extending through the bore of the well control device has been severed or cut.

The second control unit may be provided as part of, or may form, a riser control module (RCM). The RCM may be adapted to be coupled to the well control device and may be provided on or in a landing string coupled to the well control device, which landing string may form part of a through-BOP intervention riser system (TBIRS), for deploying the device into the well.

Reference to the well control device being actuated prior to actuation of the subsea BOP shear mechanism may be taken to mean that the well control device is actuated to its (fully) activated state before actuation of the subsea BOP shear mechanism commences and/or prior to commencement of movement of the shear mechanism towards its activated state, or that movement of the well control device towards its activated state is commenced prior to movement of the shear mechanism towards its activated state.

According to a second aspect of the present disclosure, there is provided a well control arrangement comprising a well control device adapted to be located in a subsea blow-out preventer (BOP), and a control system for automatically operating the well control device, the control system comprising: a first control unit configured to detect a signal indicative of a requirement to trigger actuation of a shear mechanism of the subsea BOP, to cause the shear mechanism to move from a deactivated state to an activated state in which it provides a well control function; and a second control unit connected to the well control device, for triggering actuation of the well control device to cause it to move from a deactivated state to an activated state in which the well control device provides a well control function; in which the first control unit is connected to the second control unit and configured to issue an activation command to the second control unit to cause it to trigger actuation of the well control device; in which the first control unit is configured to automatically issue the activation command to the second control unit on detecting issue of the signal indicative of a requirement to trigger actuation of the subsea BOP shear mechanism; and in which the first control unit and the second control unit are configured so that the activation command is issued to the second control unit to trigger actuation of the well control device prior to actuation of the subsea BOP shear mechanism.

The well control arrangement may take the form of a TBIRS comprising a landing string and the well control device.

According to a third aspect of the present disclosure, there is provided a well control assembly comprising: a subsea blow-out preventer (BOP); a well control device located in the subsea BOP; and a control system for automatically operating the well control device, the control system comprising: a first control unit configured to detect a signal indicative of a requirement to trigger actuation of a shear mechanism of the subsea BOP, to cause the shear mechanism to move from a deactivated state to an activated state in which it provides a well control function; and a second control unit connected to the well control device, for triggering actuation of the well control device to cause it to move from a deactivated state to an activated state in which the well control device provides a well control function; in which the first control unit is connected to the second control unit and configured to issue an activation command to the second control unit to cause it to trigger actuation of the well control device; in which the first control unit is configured to automatically issue the activation command to the second control unit on detecting issue of the signal indicative of a requirement to trigger actuation of the subsea BOP shear mechanism; and in which the first control unit and the second control unit are configured so that the activation command is issued to the second control unit to trigger actuation of the well control device prior to actuation of the subsea BOP shear mechanism.

The subsea BOP shear mechanism may comprise one or more selectively actuatable shear elements, for shearing media deployed into a well through the device. The BOP may be a ram-type BOP, in which the shear mechanism comprises one or more shear element in the form of a shear ram, suitably at least one pair of shear rams.

The well control device may be or may comprise a valve assembly, and may comprise at least one valve. The well control device may comprise a cutting valve adapted to shear coiled tubing (or other media) extending through a bore of the device. The well control device may comprise a sealing valve adapted to seal a bore. The well control device may comprise a cutting valve and a sealing valve, and/or a valve having both cutting and sealing functions. The well control device may take the form of an SSTT, or any other suitable valve assembly that may be employed in a well to provide a well control function.

The well control device may form part of a TBIRS comprising a landing string and the well control device.

The well control function which is provided by the subsea BOP and/or well control device may be the flow of fluid in an annular region surrounding media extending through a bore of the device, and/or closure of a bore of the device by the severing of media extending through the bore. The term 'well control' should therefore be taken to encompass the control of fluid flow into/out of the well, and control of the passage of tubing, tools or other media into/out of the well.

Further features of the subsea BOP, well control device and control system of the second and third aspects of the present disclosure may be derived from the text set out elsewhere in this document, particularly in or with reference to the first aspect described above.

According to a fourth aspect of the present disclosure, there is provided a method of operating a well control assembly comprising a subsea blow-out preventer (BOP) and a well control device located within the BOP, the method comprising the steps of: providing a first control unit which is configured to detect a signal indicative of a requirement to trigger actuation of a shear mechanism of the subsea BOP to move from a deactivated state to an activated state in which it provides a well control function; providing a second control unit, and connecting the second control unit to the well control device; connecting the first control unit to the second control unit; configuring the first control unit to automatically issue an activation command to the second control unit, when the first control unit detects issue of the signal indicative of a requirement to trigger actuation of the subsea BOP shear mechanism, to cause the second control unit to trigger actuation of the well control device to move from a deactivated state to an activated state in which the well control device provides a well control function; and configuring the first control unit and the second control unit so that the activation command is issued to the second control unit to trigger actuation of the well control device prior to actuation of the subsea BOP shear mechanism.

The method may comprise arranging the first control unit to detect an alarm signal indicative of a requirement to trigger actuation of the subsea BOP shear mechanism. The alarm signal may be triggered on detection of a change in a specified at least one parameter, or an at least one parameter threshold being reached.

The method may comprise arranging the first control unit to detect at least one of: a) a signal which is issued by monitoring equipment and which is indicative of the requirement to trigger actuation of the subsea BOP shear mechanism to move to its activated state; and b) an activation command issued by control equipment to the subsea BOP, to trigger actuation of the shear mechanism to move to its activated state.

The method may comprise connecting the first control unit to an emergency disconnect system (EDS) and/or a deadman system, which may form or comprise monitoring and/or control equipment, and which may be arranged to issue the signal. The first control unit may cause the well control device to move to the activated state when the EDS/deadman system issues the signal. The method may comprise arranging the first control unit to detect an alarm signal indicating that the EDS/deadman system requires to be triggered into operation. The method may comprise arranging the first control unit to detect a command signal issued by the EDS/deadman system to cause the subsea BOP shear mechanism to be actuated. The method may comprise arranging the first control unit to detect a signal issued by a trigger for the subsea BOP shear mechanism, which causes the shear mechanism to be actuated.

The method may comprise selectively operating a reeling device to withdraw coiled tubing (or other media) extending through a bore of the well control device. The method may comprise arranging the first control unit to selectively operate the reeling device. The method may comprise arranging the first control unit to trigger the reeling device to actuate when the following conditions are satisfied: i) the requirement to actuate the subsea BOP shear mechanism is detected; ii) coiled tubing (or other media) is located in the bore of the well control device; and iii) actuation of the well control device (triggered by the activation command issued to the second control unit) presents the risk of restricting closure and/or a sealing function of the well control device. The method may comprise arranging the first control unit to trigger the reeling device to actuate when a sealing valve of the well control device is located uphole of a cutting valve of the device, and condition iii) involves a risk of the sealing valve being blocked by a severed portion of the coiled tubing (or other media).

The method may comprise providing the second control unit with a source of energy for actuating the well control device. The source of energy may be selected from the group comprising: a source of hydraulic energy; a source of electrical energy; and a combination of the two.

The method may comprise triggering at least one valve of the second control unit to move from a closed position to an open position when the activation command is received by the second control unit, to permit the flow of hydraulic fluid to the well control device, to actuate the device. The method may comprise monitoring a return flow of fluid from the control device valve and determining a corresponding actuation state of the control device valve employing return flow volume measurements. The flow monitoring device may be capable of determining an actuation state of the cutting valve by measuring the volume of fluid exiting the control device valve.

The method may comprise arranging the second control unit to transmit information relating to the operation state of the well control device valve to the first control unit. The method may comprise arranging the first control unit to employ the information to determine whether to actuate the reeling device. The first control unit may trigger the reeling device to actuate only when a further condition, which may be a condition iv), is satisfied, in which the valve is detected as having moved to its fully closed position.

Optional further features of the method may be derived from the text set out elsewhere in this document, particularly in or with reference to the first, second and/or third aspects described above.

BRIEF DESCRIPTION OF THE DRAWINGS

An embodiment of the present invention will now be described, by way of example only, with reference to the accompanying drawings, in which.

DETAILED DESCRIPTION

Figure 1:
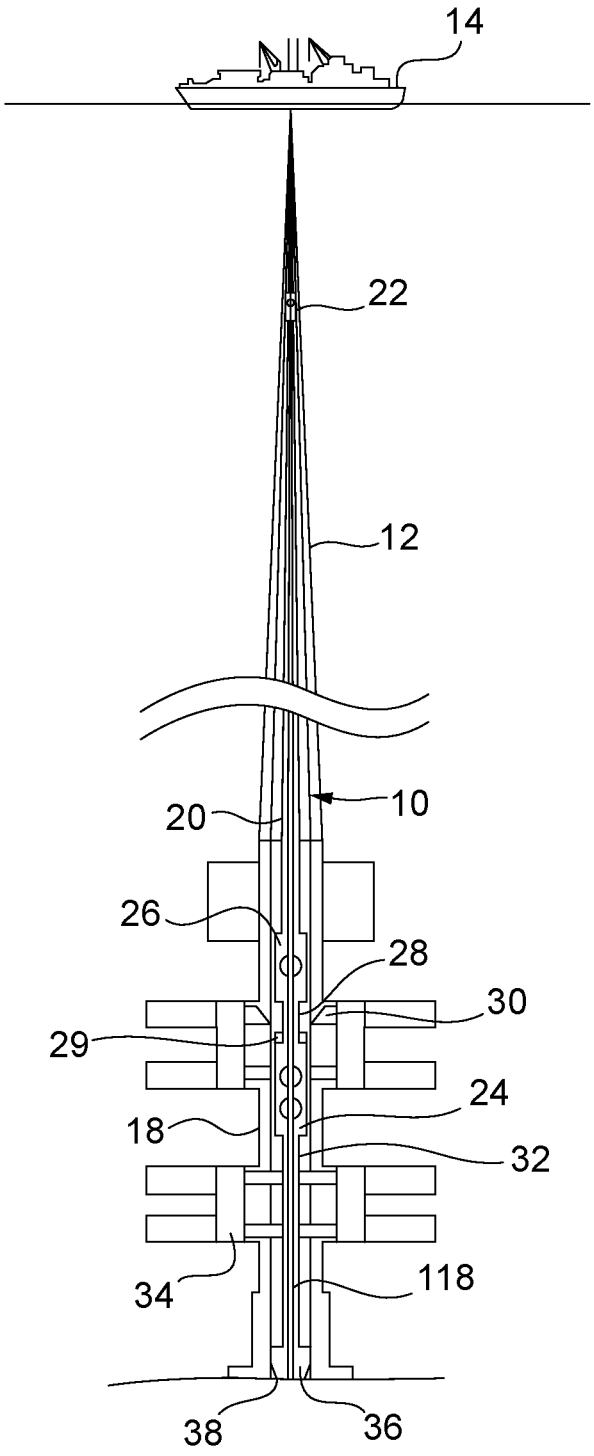
FIG. 1 is a schematic side view of a through-BOP intervention riser system (TBIRS) of a conventional type, incorporating a well control device in the form of a subsea test tree (SSTT) located in a subsea BOP.

Turning firstly to FIG. 1, there is shown a schematic view of a through-BOP intervention riser system (TBIRS) 10, shown in use during an exploration and appraisal (E & A) procedure. The TBIRS 10 is located within a marine riser 12 and extends between a surface facility in the form of a vessel 14 and a subsea BOP 18, which is mounted on a wellhead (not shown). The use and functionality of a TBIRS is well known in the industry for through-riser deployment of equipment, such as completion architecture, well testing equipment, intervention tools and the like, into a subsea well from a surface vessel. In this regard, it will be noted that through-BOP intervention riser systems have previously been referred to in the industry more generally as a 'landing string'.

When in a deployed configuration the TBIRS 10 extends through the marine riser 12 and into the BOP 18. While deployed the TBIRS 10 provides many functions, including permitting the safe deployment of wireline or coiled tubing equipment (coiled tubing being shown at 118 in the drawing) through the TBIRS and into the well, providing the necessary well control barriers and permitting emergency disconnect while isolating both the well and the TBIRS. Wireline or coiled tubing deployment may be facilitated via a lubricator valve 22 which is located proximate the surface vessel 14.

Well control and isolation in the event of an emergency disconnect is provided by a suite of valves, which are located at a lower end of the TBIRS 10 inside the BOP, and carried by a landing string 20 of the TBIRS. The valve suite includes a well control device in the form of a subsea test tree (SSTT) 24, which forms part of the TBIRS 10, and which provides a safety barrier to contain well pressure, and functions to cut any coiled tubing, wireline or other media which extends through the a bore of the SSTT. The valve suite can also include an upper valve assembly, typically referred to as a retainer valve (RV) 26, which isolates the landing string contents and which can be used to vent trapped pressure from between the RV 26 and the SSTT 24.

A shear sub component 28 extends between the RV 26 and SSTT 24, which is capable of being sheared by shear rams 30 of the BOP 18, if required. A latch 29 connects the landing string 20 to the SSTT 24 at the shear sub 28. A slick joint 32 extends below the SSTT 24, and facilitates engagement with BOP pipe rams 34.

In the E & A procedure shown in FIG. 1, the TBIRS 10 includes a fluted hanger 36 at its lowermost end, which engages with a wear bushing 38. When the TBIRS 10 is fully deployed and the corresponding hanger 36 and bushing 38 are engaged, the weight of the lower string (such as a completion, workover string or the like which extends into the well and thus is not illustrated) becomes supported through the wellhead.

Figure 2:
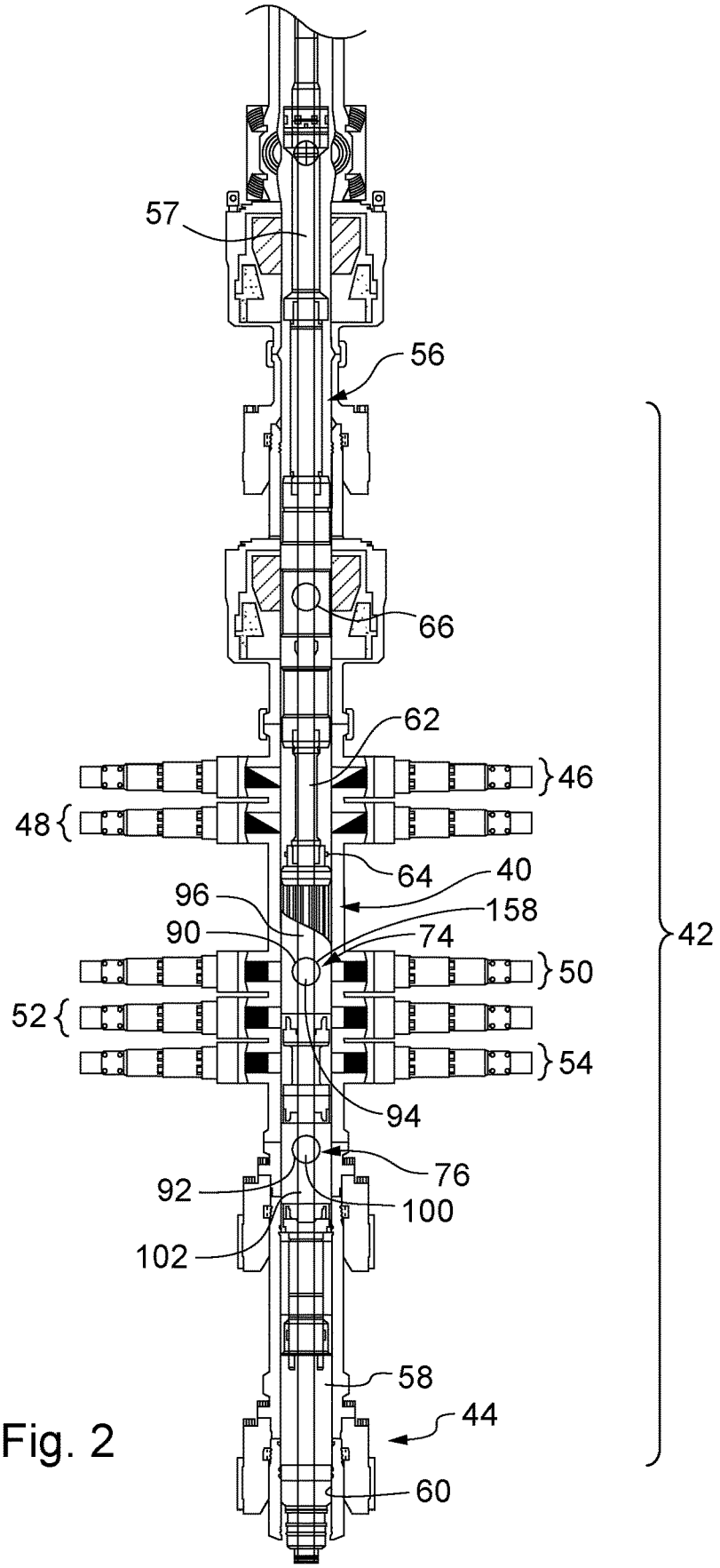
FIG. 2 is a schematic side view of a TBIRS well control device in the form of an SSTT, comprising a control system according to an embodiment of the present disclosure, the SSTT located in a subsea BOP, and the SSTT and BOP shown in deactivated states.

Turning now to FIG. 2, there is shown a schematic side view of an SSTT according to an embodiment of the present disclosure, indicated generally by reference numeral 40 and illustrated in greater detail than the SSTT 24 in FIG. 1. The SSTT 40 is located in a subsea BOP 42 that is mounted on a wellhead 44. The BOP 42 is shown in FIG. 2 with a shear mechanism in a deactivated state. A typical intervention procedure may involve running a downhole tool or other component through the TBRIS 10 (including the RV 66 and SSTT 40) and into the well on coiled tubing, wireline or slickline (such as the coiled tubing 118 shown in FIG. 1), as is well known in the field of the invention. The BOP 42 shown in the drawing includes two sets of shear rams 46 and 48, and three sets of pipe (seal) rams 50, 52 and 54.

In common with the SSTT 24 shown in FIG. 1, the SSTT 40 is run into the subsea BOP 42 on a landing string 20, and is locked in the wellhead 44 by a tubing hanger 58. The SSTT 40 is connected to a shear sub 62 via a latch 64. The latch 64 can be activated to release the landing string 20, for recovery to surface, say in the event of an emergency quick disconnect (EQD) being carried out, leaving the SSTT 40 in place within the subsea BOP 42. A retainer valve 66 is provided above the shear sub 62, and is connected to the landing string 20, via a spacer sub 56 and an annular slick joint 57.

Figure 3:
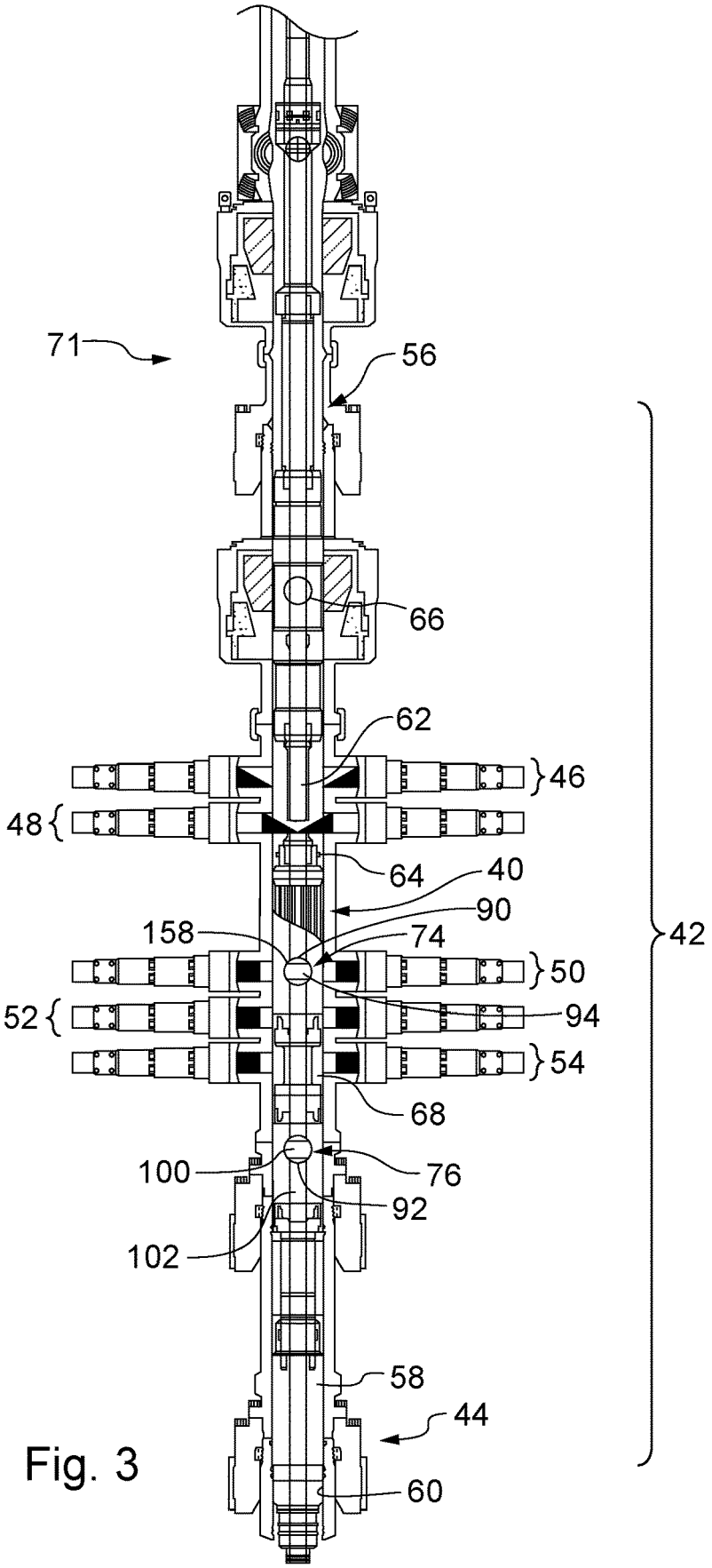
FIG. 3 is a view of the SSTT of FIG. 2, showing the BOP and the SSTT in activated states.

In the event of an emergency situation arising, the subsea BOP shear rams 46 and/or 48 can be operated to sever the shear sub 62. This is shown in FIG. 3, which is a view similar to FIG. 2, but which shows the subsea BOP 42 following operation of the lower shear rams 48. The pipe ram 54 would also be activated, sealing the annulus 68 between an external surface of an integral slick joint of the SSTT 40 and an internal wall of the BOP 42. The well has then been contained and the severed landing string 20 can be recovered to surface, and a lower marine riser package (LMRP) 71 coupled to the subsea BOP 42 disconnected if required.

As explained in detail above, problems can occur in the SSTT 40, in the event that control lines are severed by the subsea BOP shear rams 46, 48. In particular, shearing of the control lines may prevent subsequent operation of the SSTT 40 if media (such as the coiled tubing 118) resides in the SSTT bore which cannot be sheared by the SSTT. The present disclosure addresses these problems, by ensuring actuation of the SSTT 40 to a closed state prior to shearing of control lines by the subsea BOP 42.

The SSTT 40 generally comprises upper and lower valves 74 and 76, which have at least one of a cutting function and a sealing function. In the illustrated embodiment, the upper valve 74 has a sealing function, whilst the lower valve 76 has a cutting function. A suitable cutting valve is disclosed in the applicant's International patent application no. PCT/GB2015/053855 (WO-2016/113525), the disclosure of which is incorporated herein by this reference. In variations, one or both of the SSTT valves 74 and 76 can have both a cutting and a sealing function; the valve functions may be reversed; or a single shear and seal type valve may be used. The SSTT valves 74 and 76 are each moveable between an open position, which is shown in FIG. 2, and a closed position, which is shown in FIG. 3. Movement of the SSTT valves 74 and 76 between their open and closed positions is controlled via hydraulic fluid supplied to the valves through control lines, as will be described in more detail below.

Figure 4:
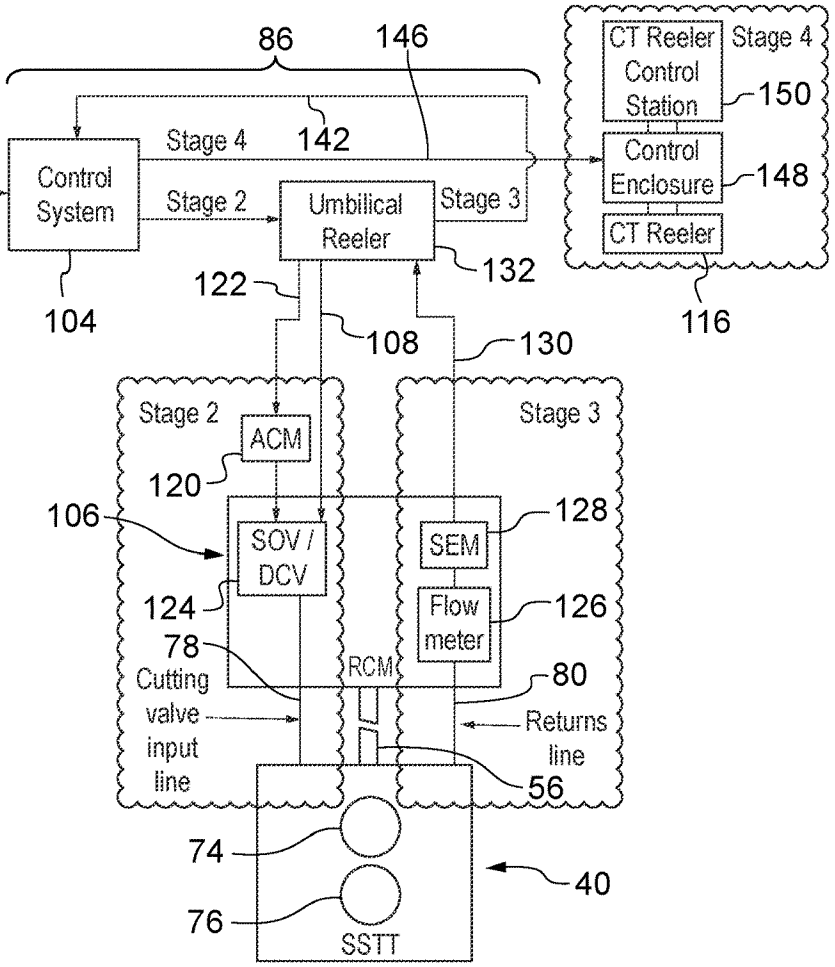
FIG. 4 is high level schematic view illustrating the SSTT and control system of FIG. 2.

Turning now to FIG. 4, there is shown a high level schematic illustration of a control system according to an embodiment of the present disclosure, the control system indicated generally by reference numeral 86. The control system 86 is for automatically operating a well control device, in particular the SSTT 40 of the TBIRS shown in FIGS. 2 and 3. The control system 86, together with the SSTT 40, forms a well control arrangement. The well control arrangement, together with the subsea BOP 42, forms a well control assembly.

FIG. 4 shows control lines 78 and 80, which are associated with the lower (cutting) SSTT valve 76. Separate control lines are also provided for the upper (sealing) SSTT valve 74, but are not shown in the drawing. Hydraulic fluid is supplied to the valve 76 via the control line 78, which forms an input line to actuate the valve from its open position to its closed position. Hydraulic fluid that is exhausted from the valve 76 during its movement to the closed position exits the valve via the control line 80, which forms a return line. It will be understood that actuation of the valve 76 from its closed to its open position would involve the reverse flow of fluids through the lines 78 and 80.

The SSTT valves 74 and 76 can be of any suitable type, but are typically ball-type valves, comprising respective ball members 90 and 92 shown in FIGS. 2 and 3, which are rotatable between open and closed positions. In the open position of the upper valve ball member 90, a bore 94 of the ball member is aligned with a bore 96 of the SSTT 40, whilst in a closed position, the bore 94 is disposed transverse to the SSTT bore 96, thereby sealing the SSTT bore. The lower SSTT ball member 92 similarly comprises a bore 100 which, in the open position, is aligned with the bore 96, and in the closed position is transverse to the bore, thereby cutting coiled tubing (or any other media) extending through the bore.

The control system 86 generally comprises a first control unit 104, and a second control unit 106. The first control unit 104 is configured to detect a signal indicative of a requirement to trigger actuation of the subsea BOP 42, to cause the BOP shear rams 46, 48 to move from a deactivated state to an activated state in which they provide a well control function. The second control unit 106 is connected to the RV 66 and SSTT 40, for triggering actuation of the SSTT to cause it to move from a deactivated state to an activated state in which it provides a well control function.

The first control unit 104 is connected to the second control unit 106, and is configured to issue an activation command to the second control unit to cause it to trigger actuation of the SSTT 40. The first control unit 104 is configured to automatically issue the activation command to the second control unit 106 on detecting issue of the signal indicative of the requirement to trigger actuation of the subsea BOP 42 shear rams 46, 48. The RV 66 can also be actuated to isolate the landing string contents.

The first and second control units 104 and 106 are configured so that the activation command is issued to the second control unit, to trigger actuation of the SSTT 40, prior to actuation of the subsea BOP 42 shear rams 46 and 48. The control system 86 of the present disclosure may therefore provide the advantage that the system can automatically trigger actuation of the SSTT 40, prior to closure of the subsea BOP 42 shear rams 46 and 48, when a requirement to trigger actuation of the BOP is detected. In this way, actuation of the SSTT 40 can be ensured, as actuation is effected prior to control lines coupled to the SSTT being disconnected. In the illustrated embodiment, the shear rams 46/48 of the BOP 42 sever the control lines (including lines 78 and 80) which are coupled to the SSTT 40 when they are actuated. The control system 86 therefore ensures operation of the SSTT 40 prior to the control lines being severed.

The first control unit 104 is a surface unit, which is typically provided at surface level, for example on the vessel 14 shown in FIG. 1. It is conceivable however that the first control unit 104 could be provided on or at seabed level. The second well control unit 106 is provided subsea, and in particular is provided in or as part of the TBIRS 10 shown in FIG. 1. This may provide the advantage that the second control unit 106 is positioned relatively close to the SSTT 40, so that it can rapidly actuate the SSTT on receipt of the activation command from the first control unit 104.

Whilst the second control unit 106 is typically provided as part of the TBIRS 10, and positioned above the BOP 42, it is conceivable that the second control unit 106 could be provided within the subsea BOP 42. This will ultimately depend, in the illustrated embodiment, upon the precise positioning of the SSTT 40 or other well control device whose function is controlled by the control system 86.

The first control unit 104 is connected to the second control unit 106 via a control line 108. In the illustrated embodiment, the control line 108 is an electrical control line, and the first control unit 104 is configured to issue an electrical activation command to the second control unit 106. This may provide the advantage that the activation command can be transmitted to the second control unit 106 relatively rapidly, on detection of the signal indicative of a requirement to trigger actuation of the subsea BOP 42 by the first control unit 104.

The subsea BOP 42 is actuated from surface, requiring a volume of high pressure fluid to actuate the shear rams 46, 48 and pipe rams 50, 52 and 54, which is transmitted via hydraulic control lines (not shown) extending from a source of hydraulic fluid which can be provided at surface, or in the subsea environment (e.g. hydraulic accumulators). Delays in actuation of the shear rams 46 and 48 of the subsea BOP 42, including due to the requirement to apply significant hydraulic fluid pressure force to the shear rams to operate them, can result in a delay of, perhaps, 35 to 40 seconds occurring between issue of an activation command to the BOP, and actuation of the BOP shear rams. In contrast, it is expected that a delay of no more than perhaps 5 seconds may be experienced between detection of the signal indicative of a requirement to trigger the subsea BOP 42 (by the first control unit 104), and actuation of the SSTT 40.

The first control unit 104 can be arranged to issue the activation command to the second control unit 106, to cause the second control unit to actuate the SSTT 40, in two main ways.

In a first option, the first control unit 104 is configured to detect an alarm signal indicative of a requirement to trigger actuation of the subsea BOP 42. The alarm signal may be triggered on detection of a change in a specified parameter or parameters, and/or an at least one parameter threshold being reached. As is well known, the parameter may be selected from the group comprising a pressure of fluid in the wellbore, a flow rate of fluid, a flow direction of fluid, a vessel moving off station through drive-off or drift-off, loss of power and hydraulic supply to the subsea BOP, and a combination of two or more of these parameters. An increase in pressure, and unexpected flow of fluid into the wellbore, may occur during a 'kick'.

FIG. 4 shows an alarm 110, which may be an audible and/or visual alarm (or beacon) that is triggered when the parameter or parameters mentioned above, monitored by separate equipment of a type which is well known in the field of the invention (not shown), indicate that activation of the subsea BOP 42 is required. On detection of the alarm signal generated by the alarm 110, the first control unit 104 issues the activation command to the second control unit 106, via the control line 108. This in-turn causes the SSTT 40 to be triggered to actuate to move its valves 74 and 76 to their closed positions, controlled by the second control unit 106. The SSTT 40 is typically operated so that the upper, sealing valve 74 is actuated with a time delay relative to the lower, cutting valve 76. In this way, the lower cutting valve 76 is provided with sufficient time to cut coiled tubing (or other media) extending though the bore 96 of the SSTT 40, and the coiled tubing remaining in the SSTT bore above the lower valve 76 retrieved prior to actuation of the upper sealing valve 74 to its closed, sealing position.

A second option in which the activation command is issued by the first control unit 104 to the second control unit 106 is one in which an activation command is automatically issued to the subsea BOP 42 to move to its activated state. The activation command is detected by detection equipment, indicated at 112 in FIG. 4, and which can detect the actuation of an emergency disconnect sequence (EDS), or a deadman system. Actuation of the subsea BOP 42 is carried out on an automated basis, without requiring operator intervention. It will be understood however that the BOP shear rams 46 and 48 may be operated outside of the EDS/deadman function if desired or required, which would be detected by the detection equipment 112, and so that the detection equipment may be capable of detecting actuation of a command button (not shown) for the BOP shear rams 46, 48.

In the first option discussed above, in which the activation command is issued to the second control unit 106 when the alarm 110 is operated, the alarm 110 may be associated with monitoring equipment, also indicated with the numeral 112. The BOP shear rams 46 and 48 may be operated via a command button (not shown), which can be activated by an operator when the alarm 110 is operated, and which will trigger actuation of the subsea BOP 42. The first control unit 104 has an interface with the detection equipment 112, indicated schematically by numeral 114. Detection that the alarm 110 has been triggered (leading to EDS, deadman system or BOP shear ram actuation) will therefore be recognised by the first control unit 104, via its interface 114 with the monitoring equipment 112, and will then issue the activation command to the second control unit 106, to operate the SSTT 40. In the second option in which the BOP shear rams 46, 48 are automatically actuated, the detection equipment 112 acts to detect activation of the EDS/deadman system/BOP shear rams, and the first control unit 104 issues the activation command to the second control unit 106 automatically.

One way in which the first control unit 104 may be caused to issue the activation command is by providing an interface 114 in the form of a pneumatic line coupled to an EDS/deadman system/shear ram activation command button. When the button is pressed, the pneumatic line 114 is tripped, to issue a pneumatic signal to the first control unit 104, which causes the control unit to issue the activation command. Another way in which this could be achieved is by providing an interface 114 in the form of an electric line coupled to the EDS/deadman system/shear ram activation command button, which trips an electric circuit when the button is pressed, to communicate actuation of the button to the first control unit 104.

It will be understood that the first control unit 104, second control unit 106, and the detection equipment 112, will all include suitable computer processors and/or data storage media, operating suitable software, which enables their operation as described above.

The first control unit 104 can also be configured to operate a reeling device 116, to retract coiled tubing (or other media) extending through the bore 96 of the SSTT 40. FIG. 1 shows a coiled tubing 118 deployed from the vessel 14 through the landing string 10, RV 26 and SSTT 24 and into the wellbore of the well. As is well known in the industry, coiled tubing provides an efficient means of deploying equipment into a well, and is used in many scenarios. The coiled tubing is wound on to a reel (not shown) on the vessel 14, and deployed from the reel down through the TBIRS 10 when required. In a similar fashion, wireline or slickline (not shown) may be employed to deploy a tool into a well, at least in wells which are substantially vertical. Wireline and slickline is also deployed from a reel using suitable equipment.

In the specific context of the SSTT 40 shown in FIGS. 2 and 3, in which the lower valve 76 provides a cutting function and the upper valve 74 a sealing function, operation of the SSTT 40 presents a risk of the bore 94 of the upper sealing valve being blocked by the coiled tubing, or indeed other media which has been deployed through the SSTT, and which is present in the bore 96 when the SSTT is actuated to close the valves 74 and 76. Whilst the lower, cutting valve 76 can sever and so cut coiled tubing (or other media), the portion of coiled tubing located above the lower cutting valve 76 will block the bore 94 of the upper sealing valve 74, preventing it from moving from its open position of FIG. 2 to its closed position of FIG. 3. The first control unit 104 can therefore be configured to operate the reeling device 116 so as to retract the portion of coiled tubing above the cut from the SSTT 40, so as to clear the bore 94 of the upper sealing valve 74, and ideally a bore of the RV 66. This ensures correct operation of the sealing valve 74 to seal the bore 96 of the SSTT assembly 40, and provides well control.

As discussed elsewhere in this document, an SSTT (or other well control device) can be provided which has a single shear and seal mechanism, or in which the SSTT upper valve 74 is the cutting valve. In this situation, the first control unit 104 would not need to be configured to operate the reeling device 116, unless considered necessary by the end user.

The first control unit 104 is configured to trigger the reeling device 116 to actuate under specified conditions. Firstly, the first control unit 104 must have detected the signal indicative of the requirement to trigger actuation of the subsea BOP 42. Secondly, the first control unit 104 is programmed to recognise that the coiled tubing (or other media) is located in the bore 96 of the SSTT 40. This can be achieved in numerous ways, including by communication between the first control unit 104 and the reeling device 116, and/or by suitable sensors provided in the SSTT 40. Thirdly, the first control unit 104 is programmed to recognise that actuation of the SSTT 40 would restrict the function of the SSTT (e.g. correct operation of the upper, sealing valve 74), and initiates the reeling device 116 after a specified time period has passed.

The first control unit 104 will be programmed with information relating to the type of SSTT 40 which has been deployed, and so will recognise that actuation of the lower cutting valve 76 presents a risk of the bore 94 of the upper sealing valve 74 being blocked when the SSTT 40 is actuated. Issue of the activation command from the first control unit 104 to the second control unit 106, to trigger actuation of the SSTT 40, can also actuate the first control unit 104 to operate the reeling device 116. Operation of the reeling device 116 is scheduled, by the first control unit 104, so that the reeling device only operates to withdraw the coiled tubing (or other media) following correct operation of the lower cutting valve 76 to move to its fully closed position of FIG. 3, in which it shears the coiled tubing. The upper sealing valve 74 is scheduled to operate with a time-delay relative to operation of the lower cutting valve 76. This provides time for withdrawal of the coiled tubing following the cutting process.

The second control unit 106 also comprises a source of energy for actuating the SSTT 40. In the illustrated embodiment, the second control unit 106 comprises a source of hydraulic energy in the form of a subsea accumulator 120. The accumulator 120 comprises a volume of pressurised fluid, and is typically charged with the fluid prior to deployment of the TBIRS 10 from surface. In addition, the accumulator 120 can be supplied with hydraulic fluid via a hydraulic control line 122 extending to surface and connected to the first control unit 104. Whilst reference is made to a hydraulic energy source, it will be understood that other types of energy source may be provided, including a source of electrical energy such as a battery and/or an electrical power conduit extending to surface.

The second control unit 106 also comprises a valve 124 which is operable to control the flow of hydraulic fluid from the accumulator 120 to the SSTT 40 to operate the valves 74 and 76. As discussed above, FIG. 4 shows a cutting valve input line 78 which is supplied with hydraulic fluid from the accumulator 120 under the control of the valve 124. The valve 124 is typically a solenoid operated valve (SOV) and/or a directional control valve (DCV), which can be selectively actuated to allow pressurised hydraulic fluid to be supplied through the control line 78 to the lower cutting valve 76, to actuate the valve from its open position of FIG. 2 to its closed position of FIG. 3.

The second control unit also comprises a flow monitoring device, in the form of a flow meter 126, which is also coupled to the SSTT 40, in this case to the lower cutting valve 76, via the hydraulic return line 80. As will be understood by persons skilled in the art, the hydraulically actuated cutting valve 76 is actuated to move from its open position by the supply of hydraulic fluid along the cutting valve input line 78, with fluid exhausted from an actuating cylinder of the valve (not shown) along the return line 80. The flow meter 126 monitors the flow of fluid exhausted from the cutting valve 76, and determines a corresponding actuation state of the valve. In the illustrated embodiment, the flow meter 126 serves for monitoring the flow of fluid exhausted from the cutting valve 76 during movement from its open to its closed position.

The flow meter 126 is capable of determining the actuation state of the cutting valve 76 by measuring the volume of fluid exiting the valve. Actuation of the cutting valve 76 to its fully closed position requires that a determined volume of fluid exit the valve actuating cylinder. The flow meter 126 can therefore determine that the cutting valve 76 has been fully closed when the determined volume of fluid is detected as having exited the valve. This enables a determination to be made that the cutting valve 76 has moved to its fully closed position of FIG. 3, therefore severing the coiled tubing (or other media) extending through the bore 96 of the SSTT 40.

The second control unit 106 also comprises a subsea electronics module (SEM) 128, which can transmit information relating to the activation state of the cutting valve 76, determined using the flow meter 126, to the first control unit 104 at the surface via an electrical control line 130. The first control unit 104 is configured to employ the information relating to the activation state of the cutting valve 76 to determine whether to actuate the reeling device 116.

The first control unit 104 may be configured to trigger the reeling device 116 to actuate only when a further condition is satisfied, in which the cutting valve 76 is detected as having moved to its fully closed position of FIG. 3. This ensures that the reeling device 116 is not operated until such time as a determination has been made that the coiled tubing 118 (or other media) extending through the bore 96 of the SSTT 40 has been cut. Operation of the reeling device 116 is therefore sequenced so that the coiled tubing is withdrawn from the bore 94 of the upper sealing valve 74 only after cutting of the coiled tubing has been effected by the lower cutting valve 76. Operation of the valve 124 to supply hydraulic fluid to the cutting valve 76 through the input line 78 is controlled by the activation command issued from the first control unit 104 to the second control unit 106 via the electrical control line 108.

In the illustrated embodiment, the second control unit 106, comprising the valve 124, flow meter 126 and SEM 128, is provided as a unit in a riser control module (RCM), which is deployed subsea using the TBIRS 10, and which is connected to the SSTT 40. The umbilical is retracted on the umbilical reeler 132 with the landing string 56 when disconnected, the control system being connected to the umbilical reeler such that appropriate control signals can be sent.

Figure 5:
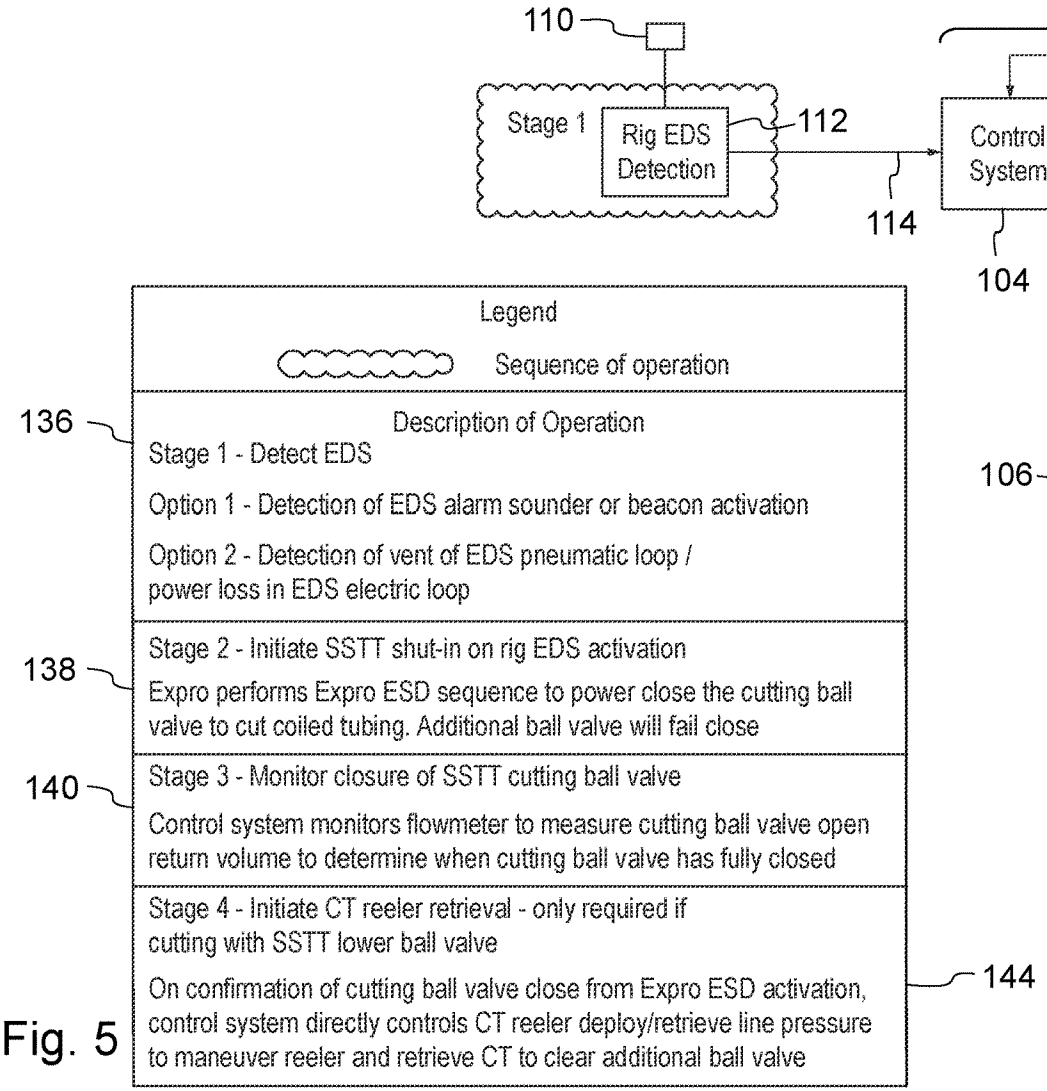
FIG. 5 is a flow chart illustrating stages in an operation sequence of a well control arrangement comprising the SSTT and the control system of FIGS. 2 to 4.

FIG. 5 is a flow chart illustrating stages in the operation of the control system 86, and of the well control arrangement comprising the SSTT 40 and the control system.

A first stage is indicated in box 136, in which a requirement to perform an EDS, deadman operation or subsea BOP shear ram activation has occurred, for example due to a 'kick', in which an uncontrolled flow of fluid into the wellbore has occurred, or the surface vessel 14 drifting off station. As discussed in detail above, the first control unit 104 may detect operation of an alarm 110 indicating a requirement to trigger the EDS, deadman system or subsea BOP shear ram activation (involving actuation of the subsea BOP 42), or may detect an automatic actuation of the EDS, deadman system or subsea BOP shear ram activation.

A second stage is indicated by box 138, in which the first control unit 104, having detected the signal indicative of a requirement to trigger actuation of the subsea BOP 42, issues the activation command to the second control unit 106 located subsea. The activation command is transmitted via the electrical control line 108 to operate the valve 124 and supply pressurised hydraulic fluid to the lower cutting valve 76, via the hydraulic cutting line 78. Hydraulic fluid may also be supplied to actuate the upper sealing valve 74, although as is well known, the sealing valve may be biased, for example by a spring (not shown), to automatically move to its closed position of FIG. 3 (and so to "fail close").

A third stage is indicated by box 140, in which the flow meter 126 monitors the return flow of fluid exiting the cutting valve 76, via the hydraulic return line 80, to determine when the cutting valve 76 has moved to its fully closed position of FIG. 3. The data relating to the actuation state of the cutting valve 76 is transmitted from the second control unit 106 to the first control unit 104 under the control of the SEM 128, and via the electrical control line 130. When a determination is made that the cutting valve 76 has fully closed, this information is fed to the first control unit 104, as indicated by the arrow 142 in FIG. 4.

On detection that the cutting valve 76 has fully closed, a fourth stage may be entered, as indicated by the box 144 in FIG. 5. In this stage, and taking account of the factors discussed above in terms of the presence of coiled tubing (or other media) in the bore 96 of the SSTT 40, the first control unit 104 triggers initiation of the reeling device 116, to retrieve the coiled tubing and so retract it from the bore 94 of the upper sealing valve 74, as indicated by the arrow 146 in FIG. 4. The trigger command for the reeling device 116 is relayed to a control enclosure 148. Operation of the reeling device 116 is controlled from a control station 150 associated with the control enclosure 148, which can cause the reeling device 116 to be triggered into operation. Operation of the reeling device 116 may require operator input, or may be automatic. On activation of the reeling device 116, appropriate hydraulic control of deploy and retrieve line pressure in a hydraulic control system (not shown) for the reeler 116 is provided, to manoeuvre the reeler and retrieve the coiled tubing, to clear the upper sealing valve bore 94 and RV 66 if required.

The control system 86 of the present disclosure, and the well control arrangement comprising the SSTT 40 and the control system, enables actuation of the SSTT 40 prior to closure of the BOP 42 (in particular the shear rams 46 and 48 of the BOP). This ensures that the SSTT valves 74 and 76 can be actuated to move from their open positions to their closed positions prior to the BOP shear rams 46 and 48 severing control equipment associated with the SSTT 40 (the electrical control lines 108 and 130, and the hydraulic control line 122 provided in the umbilical). Following retrieval of the landing string 20, leaving the SSTT 40 positioned within the bore of the subsea BOP 42, the well is therefore safely contained and the marine riser 12 can be disconnected from the subsea BOP 42 and retrieved to the vessel 14, if required.

Various modifications may be made to the foregoing without departing from the spirit or scope of the present invention.

For example, other means of connecting the first control unit to the second control unit may be employed, including but not restricted to electromagnetic signalling equipment comprising a transmitter associated with the first control unit and a receiver associated with the second control unit, which may be adapted to transmit and receive radio frequency or acoustic (e.g. ultrasonic) frequency signals, respectively. A landing string coupled to the second control unit may act as a signal transmission medium.

The present disclosure is described in the particular context of operating a well control device in the form of an SSTT. It will be understood however that the control system and operating principles described in this document may be applied to other types of well control devices, including other types of valves and valve assemblies, and SSTTs which are configured differently to that described above. Particular alternative valves may have only a single valve element, and/or can comprise a valve having a cutting and sealing function. Alternative SSTTs may have cutting and sealing valves which are arranged differently to that described above (e.g. with a cutting valve located above a sealing valve), and/or can comprise one or more valve which has a cutting and sealing function.

Reference is made to components, e.g. valves of an SSTT, which are located above or below one another. It will be understood that this should take account of any deviations from the vertical which might exist.

Various aspects, embodiments and features of an exemplary control system and/or a well control assembly/arrangement will be presented in the following enumerated clauses:

Clause 1. A control system for automatically operating a well control device located in a subsea blow-out preventer (BOP), the control system comprising:

a first control unit configured to detect a signal indicative of a requirement to trigger actuation of a shear mechanism of the subsea BOP, to cause the shear mechanism to move from a deactivated state to an activated state in which it provides a well control function; and a second control unit adapted to be connected to the well control device, for triggering actuation of the well control device to cause it to move from a deactivated state to an activated state in which the well control device provides a well control function;

in which the first control unit is connected to the second control unit and configured to issue an activation command to the second control unit to cause it to trigger actuation of the well control device;

in which the first control unit is configured to automatically issue the activation command to the second control unit on detecting issue of the signal indicative of a requirement to trigger actuation of the subsea BOP shear mechanism;

and in which the first control unit and the second control unit are configured so that the activation command is issued to the second control unit to trigger actuation of the well control device prior to actuation of the subsea BOP shear mechanism.

Clause 2. A control system as presented in clause 1, in which the first control unit is adapted to be provided at surface, and the second well control unit is adapted to be provided sub sea.

Clause 3. A control system as presented in either of clauses 1 or 2, in which the first control unit is adapted to be connected to the second control unit via at least one electrical control line, and in which the first control unit is configured to issue an electrical activation command to the second control unit.

Clause 4. A control system as presented in any preceding clause, in which the first control unit is configured to detect an alarm signal indicative of a requirement to trigger actuation of the subsea BOP shear mechanism.

Clause 5. A control system as presented in any of clauses 1 to 4, in which the first control unit is configured to detect an activation command issued by control equipment to the subsea BOP, to trigger actuation of the subsea BOP shear mechanism to move to its activated state.

Clause 6. A control system as presented in any preceding clause, in which the first control unit is configured to detect at least one of:

a) a signal which is issued by monitoring equipment and which is indicative of the requirement to trigger actuation of the subsea BOP shear mechanism to move to its activated state; and b) an activation command issued by control equipment to the subsea BOP, to trigger actuation of the shear mechanism to move to its activated state.

Clause 7. A control system as presented in any preceding clause, in which the first control unit comprises an interface configured to cooperate with monitoring and/or control equipment, to detect issue of the signal.

Clause 8. A control system as presented in clause 7, in which the interface is adapted to be associated with a trigger for the subsea BOP shear mechanism, and is configured to detect operation of the trigger.

Clause 9. A control system as presented in any preceding clause, in which the first control unit is configured to operate a reeling device to withdraw media extending through a bore of the well control device.

Clause 10. A control system as presented in clause 9, in which the first control unit is configured to trigger the reeling device to actuate when the following conditions are satisfied:

i) the requirement to actuate the subsea BOP shear mechanism is detected;

ii) media is located in the bore of the well control device; and iii) actuation of the well control device presents the risk actuation of the well control device being restricted.

Clause 11. A control system as presented in any preceding clause, in which the second control unit comprises a source of hydraulic energy for actuating the well control device.

Clause 12. A control system as presented in clause 11, in which the second control unit comprises at least one valve for controlling the flow of hydraulic fluid from the source of hydraulic energy to the well control device when the activation command is received by the second control unit.

Clause 13. A control system as presented in either of clauses 11 or 12, in which the second control unit comprises a flow monitoring device which is adapted to be coupled to at least one valve of the well control device, which serves for monitoring the flow of fluid from the valve and determining a corresponding actuation state of the valve.

Clause 14. A control system as presented in clause 13, in which the flow monitoring device is capable of determining an actuation state of the control device valve by measuring a volume of fluid exiting the valve.

Clause 15. A control system as presented in clause 14, in which:

the first control unit is configured to operate a reeling device to withdraw media extending through a bore of the well control device;

the second control unit is configured to transmit information relating to the actuation state of the well control device valve, determined using the flow monitoring device, to the first control unit; and the first control unit is configured to employ the information to determine whether to actuate the reeling device.

Clause 16. A control system as presented in clause 15, in which the first control unit is configured to trigger the reeling device to actuate when the following conditions are satisfied:

i) the requirement to actuate the subsea BOP is detected;

ii) media is located in the bore of the well control device;

iii) actuation of the well control device presents the risk of actuation of the well control device being restricted; and iv) the well control device valve is detected as having moved to its fully closed position.

Clause 17. A well control arrangement comprising a well control device adapted to be located in a subsea blow-out preventer (BOP), and a control system for automatically operating the well control device, the control system comprising:

a first control unit configured to detect a signal indicative of a requirement to trigger actuation of a shear mechanism of the subsea BOP, to cause the shear mechanism to move from a deactivated state to an activated state in which it provides a well control function; and a second control unit connected to the well control device, for triggering actuation of the well control device to cause it to move from a deactivated state to an activated state in which the well control device provides a well control function;

in which the first control unit is connected to the second control unit and configured to issue an activation command to the second control unit to cause it to trigger actuation of the well control device;

in which the first control unit is configured to automatically issue the activation command to the second control unit on detecting issue of the signal indicative of a requirement to trigger actuation of the subsea BOP shear mechanism;

and in which the first control unit and the second control unit are configured so that the activation command is issued to the second control unit to trigger actuation of the well control device prior to actuation of the subsea BOP shear mechanism.

Clause 18. A well control arrangement as presented in clause 17, in which the well control arrangement is a through-BOP intervention riser system (TBIRS) carrying the well control device, for deploying the device subsea, and in which the second well control unit is provided in the TBIRS.

Clause 19. A well control arrangement as presented in either of clauses 17 or 18, in which the first control unit is configured to detect an alarm signal indicative of a requirement to trigger actuation of the subsea BOP shear mechanism.

Clause 20. A well control arrangement as presented in any of clauses 17 to 19, in which the first control unit is configured to detect an activation command issued by control equipment to the subsea BOP shear mechanism, to trigger actuation of the shear mechanism to move to its activated state.

Clause 21. A well control arrangement as presented in any of clauses 17 to 20, in which the first control unit is adapted to be connected to at least one of:

an emergency disconnect system (EDS) arranged to issue the signal;

a deadman system arranged to issue the signal; and a trigger for the subsea BOP shear mechanism, which issues the signal;

and in which the first control unit is configured to cause the well control device to move to the activated state when the signal is detected.

Clause 22. A well control arrangement as presented in any of clauses 17 to 21, in which the well control device is a valve assembly comprising a cutting valve adapted to sever media extending through a bore of the device, and optionally a sealing valve adapted to seal a bore of the device.

Clause 23. A well control arrangement as claimed in any of clauses 17 to 22, in which the well control device comprises a valve having both a cutting and a sealing function.

Clause 24. A well control arrangement as presented in either of clauses 22 or 23, in which the well control device takes the form of a subsea test tree (SSTT).

Clause 25. A well control arrangement as presented in any of clauses 17 to 24, in which the second control unit is provided as part of a riser control module (RCM) coupled to the well control device and provided in a TBIRS comprising the well control device, for deploying the device into the well.

Clause 26. A well control arrangement as presented in any of clauses 17 to 25, in which the control system takes the form of the control system defined in any one of claims 2 to 16.

Clause 27. A well control assembly comprising:

a subsea blow-out preventer (BOP); a well control device located in the subsea BOP; and a control system for automatically operating the well control device, the control system comprising:

a first control unit configured to detect a signal indicative of a requirement to trigger actuation of a shear mechanism of the subsea BOP, to cause the shear mechanism to move from a deactivated state to an activated state in which it provides a well control function; and a second control unit connected to the well control device, for triggering actuation of the well control device to cause it to move from a deactivated state to an activated state in which the well control device provides a well control function;

in which the first control unit is connected to the second control unit and configured to issue an activation command to the second control unit to cause it to trigger actuation of the well control device;

in which the first control unit is configured to automatically issue the activation command to the second control unit on detecting issue of the signal indicative of a requirement to trigger actuation of the subsea BOP shear mechanism;

and in which the first control unit and the second control unit are configured so that the activation command is issued to the second control unit to trigger actuation of the well control device prior to actuation of the subsea BOP shear mechanism.

Clause 28. A method of operating a well control assembly comprising a subsea blow-out preventer (BOP) and a well control device located within the BOP, the method comprising the steps of:

providing a first control unit which is configured to detect a signal indicative of a requirement to trigger actuation of a shear mechanism of the subsea BOP to move from a deactivated state to an activated state in which it provides a well control function; providing a second control unit, and connecting the second control unit to the well control device;

connecting the first control unit to the second control unit;

configuring the first control unit to automatically issue an activation command to the second control unit, when the first control unit detects issue of the signal indicative of a requirement to trigger actuation of the subsea BOP shear mechanism, to cause the second control unit to trigger actuation of the well control device to move from a deactivated state to an activated state in which the well control device provides a well control function; and configuring the first control unit and the second control unit so that the activation command is issued to the second control unit to trigger actuation of the well control device prior to actuation of the subsea BOP shear mechanism.

Clause 29. A method as presented in clause 28, comprising arranging the first control device to detect an alarm signal indicative of a requirement to trigger actuation of the subsea BOP shear mechanism.

Clause 30. A method as presented in clause 29, in which the alarm signal is triggered on detection of a change in a specified at least one parameter, or an at least one parameter threshold being reached.

Clause 31. A method as presented in clause 30, comprising arranging the first control unit to detect an activation command issued by control equipment to the subsea BOP, to trigger actuation of the shear mechanism to move to its activated state.

Clause 32. A method as presented in any of clauses 28 to 31, in which the method comprises arranging the first control unit to detect at least one of: a) a signal which is issued by monitoring equipment and which is indicative of the requirement to trigger actuation of the subsea BOP shear mechanism to move to its activated state; and b) an activation command issued by control equipment to the subsea BOP, to trigger actuation of the shear mechanism to move to its activated state.

Clause 33. A method as presented in clause 32, in which the method comprises connecting the first control unit to at least one of:

an emergency disconnect system (EDS) which is arranged to issue the signal;

a deadman system which is arranged to issue the signal; and a trigger for the shear mechanism which is arranged to issue the signal.

Clause 34. A method as presented in any of clauses 28 to 33, comprising selectively operating a reeling device to withdraw media extending through a bore of the well control device.

Clause 35. A method as claimed in clause 34, comprising arranging the first control unit to trigger the reeling device to actuate when the following conditions are satisfied:

i) the requirement to actuate the subsea BOP shear mechanism is detected;

ii) media is located in the bore of the well control device; and iii) actuation of the well control device presents the risk of closure of the well control device being restricted.

Clause 36. A method as presented in clause 35, comprising arranging the first control unit to trigger the reeling device to actuate when a sealing valve of the well control device is located uphole of a cutting valve of the device, and condition iii) involves a risk of the sealing valve being blocked by a severed portion of the media.

Clause 37. A method as presented in any of clauses 28 to 36, comprising providing the second control unit with a source of hydraulic energy for actuating the well control device, and in which the method comprises triggering at least one valve of the second control unit to move from a closed position to an open position when the activation command is received by the second control unit, to permit the flow of hydraulic fluid to the well control device, to actuate the device.

Clause 38. A method as presented in clause 37, comprising monitoring a return flow of fluid from the control device valve and determining a corresponding actuation state of the control device valve employing return flow volume measurements.

Clause 39. A method as presented in clause 38, comprising arranging the second control unit to transmit information relating to the operation state of the well control device valve to the first control unit, and arranging the first control unit to employ the information to determine whether to actuate the reeling device.

Clause 40. A method as presented in clause 39, in which the first control unit triggers the reeling device to actuate when the following conditions are satisfied:

i) the requirement to actuate the subsea BOP shear mechanism is detected;

ii) media is located in the bore of the well control device;

iii) actuation of the well control device presents the risk of closure of the well control device being restricted; and iv) the control device valve is detected as having moved to its fully closed position.

The invention claimed is:

1. A control system for automatically operating a well control device located in a subsea blow-out preventer (BOP), the control system comprising:

a first control unit configured to detect a signal indicative of a requirement to trigger actuation of a shear mechanism of the subsea BOP, to cause the shear mechanism to move from a deactivated state to an activated state in which it provides a well control function; and a second control unit adapted to be connected to the well control device, for triggering actuation of the well control device to cause it to move from a deactivated state to an activated state in which the well control device provides a well control function;

in which the first control unit is connected to the second control unit and configured to issue an activation command to the second control unit to cause it to trigger actuation of the well control device; and in which the first control unit is configured to automatically issue the activation command to the second control unit on detecting issue of the signal indicative of a requirement to trigger actuation of the subsea BOP shear mechanism; and in which the first control unit and the second control unit are configured so that the activation command is issued to the second control unit to trigger actuation of the well control device prior to actuation of the subsea BOP shear mechanism; and in which the first control unit is configured to operate a reeling device to withdraw media extending through a bore of the well control device, in which the first control unit is configured to trigger the reeling device to actuate when the following conditions are satisfied:

i) the requirement to actuate the subsea BOP shear mechanism is detected;

ii) media is located in the bore of the well control device; and iii) actuation of the well control device presents the risk actuation of the well control device being restricted.

2. The control system as claimed in claim 1, in which:

a) the first control unit is adapted to be provided at surface, and the second well control unit is adapted to be provided subsea; and/or, b) the first control unit is adapted to be connected to the second control unit via at least one electrical control line, and in which the first control unit is configured to issue an electrical activation command to the second control unit; and/or, c) the first control unit is configured to detect an alarm signal indicative of a requirement to trigger actuation of the subsea BOP shear mechanism.

3. The control system as claimed in claim 1, in which:

i) the first control unit is configured to detect an activation command issued by control equipment to the subsea BOP, to trigger actuation of the subsea BOP shear mechanism to move to its activated state; and/or, ii) the first control unit is configured to detect at least one of:

a) a signal which is issued by monitoring equipment and which is indicative of the requirement to trigger actuation of the subsea BOP shear mechanism to move to its activated state; and b) an activation command issued by control equipment to the subsea BOP, to trigger actuation of the shear mechanism to move to its activated state.

4. The control system as claimed in claim 1, in which the first control unit comprises an interface configured to cooperate with monitoring and/or control equipment, to detect issue of the signal, in which the interface is adapted to be associated with a trigger for the subsea BOP shear mechanism, and is configured to detect operation of the trigger.

5. The control system as claimed in claim 1, in which the second control unit comprises a source of hydraulic energy for actuating the well control device, in which the second control unit comprises at least one valve for controlling the flow of hydraulic fluid from the source of hydraulic energy to the well control device when the activation command is received by the second control unit.

6. The control system as claimed in claim 5, in which the second control unit comprises a flow monitoring device which is adapted to be coupled to at least one valve of the well control device, which serves for monitoring the flow of fluid from the valve and determining a corresponding actuation state of the valve.

7. The control system as claimed in claim 6, in which the flow monitoring device is capable of determining an actuation state of the control device valve by measuring a volume of fluid exiting the valve.

8. The control system as claimed in claim 7, in which:

the second control unit is configured to transmit information relating to the actuation state of the well control device valve, determined using the flow monitoring device, to the first control unit; and the first control unit is configured to employ the information to determine whether to actuate the reeling device.

9. A well control arrangement comprising a well control device adapted to be located in a subsea blow-out preventer (BOP), and a control system for automatically operating the well control device, the control system comprising:

a first control unit configured to detect a signal indicative of a requirement to trigger actuation of a shear mechanism of the subsea BOP, to cause the shear mechanism to move from a deactivated state to an activated state in which it provides a well control function; and a second control unit connected to the well control device, for triggering actuation of the well control device to cause it to move from a deactivated state to an activated state in which the well control device provides a well control function;

in which the first control unit is connected to the second control unit and configured to issue an activation command to the second control unit to cause it to trigger actuation of the well control device; and in which the first control unit is configured to automatically issue the activation command to the second control unit on detecting issue of the signal indicative of a requirement to trigger actuation of the subsea BOP shear mechanism; and in which the first control unit and the second control unit are configured so that the activation command is issued to the second control unit to trigger actuation of the well control device prior to actuation of the subsea BOP shear mechanism; and in which the first control unit is configured to operate a reeling device to withdraw media extending through a bore of the well control device, in which the first control unit is configured to trigger the reeling device to actuate when the following conditions are satisfied:

i) the requirement to actuate the subsea BOP shear mechanism is detected;

ii) media is located in the bore of the well control device; and iii) actuation of the well control device presents the risk actuation of the well control device being restricted.

10. The well control arrangement as claimed in claim 9, in which:

a) the well control arrangement is a through-BOP intervention riser system (TBIRS) carrying the well control device, for deploying the device subsea, and in which the second well control unit is provided in the TBIRS; and/or, b) the first control unit is configured to detect an alarm signal indicative of a requirement to trigger actuation of the subsea BOP shear mechanism; and/or, c) the first control unit is configured to detect an activation command issued by control equipment to the subsea BOP shear mechanism, to trigger actuation of the shear mechanism to move to its activated state; and/or, d) the first control unit is adapted to be connected to at least one of:

an emergency disconnect system (EDS) arranged to issue the signal;

a deadman system arranged to issue the signal; and a trigger for the subsea BOP shear mechanism, which issues the signal;

and in which the first control unit is configured to cause the well control device to move to the activated state when the signal is detected.

11. The well control arrangement as claimed in claim 9, in which the well control device is a valve assembly comprising a cutting valve adapted to sever media extending through a bore of the device, and a sealing valve adapted to seal a bore of the device, wherein the well control device takes the form of a subsea test tree (SSTT).

12. A well control assembly comprising:

a subsea blow-out preventer (BOP); a well control device located in the subsea BOP; and a control system for automatically operating the well control device, the control system comprising:

a first control unit configured to detect a signal indicative of a requirement to trigger actuation of a shear mechanism of the subsea BOP, to cause the shear mechanism to move from a deactivated state to an activated state in which it provides a well control function; and a second control unit connected to the well control device, for triggering actuation of the well control device to cause it to move from a deactivated state to an activated state in which the well control device provides a well control function;

in which the first control unit is connected to the second control unit and configured to issue an activation command to the second control unit to cause it to trigger actuation of the well control device;

in which the first control unit is configured to automatically issue the activation command to the second control unit on detecting issue of the signal indicative of a requirement to trigger actuation of the subsea BOP shear mechanism; and in which the first control unit and the second control unit are configured so that the activation command is issued to the second control unit to trigger actuation of the well control device prior to actuation of the subsea BOP shear mechanism; and in which the first control unit is configured to operate a reeling device to withdraw media extending through a bore of the well control device, in which the first control unit is configured to trigger the reeling device to actuate when the following conditions are satisfied:

i) the requirement to actuate the subsea BOP shear mechanism is detected;

ii) media is located in the bore of the well control device; and iii) actuation of the well control device presents the risk actuation of the well control device being restricted.

13. A method of operating a well control assembly comprising a subsea blow-out preventer (BOP) and a well control device located within the BOP, the method comprising the steps of:

providing a first control unit which is configured to detect a signal indicative of a requirement to trigger actuation of a shear mechanism of the subsea BOP to move from a deactivated state to an activated state in which it provides a well control function;

providing a second control unit, and connecting the second control unit to the well control device;

connecting the first control unit to the second control unit;

configuring the first control unit to automatically issue an activation command to the second control unit, when the first control unit detects issue of the signal indicative of a requirement to trigger actuation of the subsea BOP shear mechanism, to cause the second control unit to trigger actuation of the well control device to move from a deactivated state to an activated state in which the well control device provides a well control function; and configuring the first control unit and the second control unit so that the activation command is issued to the second control unit to trigger actuation of the well control device prior to actuation of the subsea BOP shear mechanism; and using the first control unit to operate a reeling device to withdraw media extending through a bore of the well control device, and to trigger the reeling device to actuate when the following conditions are satisfied:

i) the requirement to actuate the subsea BOP shear mechanism is detected;

ii) media is located in the bore of the well control device; and iii) actuation of the well control device presents the risk actuation of the well control device being restricted.

* * * * *